US010661556B2

(12) United States Patent
Engelhardt et al.

(10) Patent No.: US 10,661,556 B2
(45) Date of Patent: May 26, 2020

(54) METHOD FOR CONTROLLING A DISPLAY DEVICE WHICH IS CONNECTED IN DATA TERMS TO A PRINTING PRESS, AND DISPLAY DEVICE OF A PRINTING PRESS

(71) Applicant: KOENIG & BAUER AG, Würzburg (DE)

(72) Inventors: David Engelhardt, Georgsmarienhütte (DE); Harald Willeke, Paderborn (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/487,485

(22) PCT Filed: Jan. 31, 2018

(86) PCT No.: PCT/EP2018/052385
§ 371 (c)(1),
(2) Date: Aug. 21, 2019

(87) PCT Pub. No.: WO2018/153628
PCT Pub. Date: Aug. 30, 2018

(65) Prior Publication Data

US 2020/0055308 A1 Feb. 20, 2020

(30) Foreign Application Priority Data

Feb. 23, 2017 (DE) ..... 10 2017 202 937

(51) Int. Cl.
*B41F 33/00* (2006.01)

(52) U.S. Cl.
CPC ..... *B41F 33/0009* (2013.01); *B41F 33/0045* (2013.01); *B41F 33/0054* (2013.01)

(58) Field of Classification Search
CPC ..... B41F 33/0009; B41F 33/0045; B41F 33/0054
See application file for complete search history.

(56) References Cited

U.S. PATENT DOCUMENTS 4,967,379 A * 10/1990 Ott ..... B41F 33/0045 101/211
7,876,441 B2 * 1/2011 Fejfar ..... B41F 33/0036 356/402

(Continued)

FOREIGN PATENT DOCUMENTS

DE 102009027142 A1 12/2010
DE 102011075347 A1 11/2012

(Continued)

OTHER PUBLICATIONS

International Search Report of PCT/EP2018/052385 dated Apr. 18, 2018.

*Primary Examiner* — David H Banh
(74) *Attorney, Agent, or Firm* — Mattingly & Malur, PC

(57) ABSTRACT

A display device which is connected, in data terms, to a printing press, is controlled. A depiction of a printed image, which is printed onto a printing material by the printing press, together with a plurality of ink zones, arranged next to one another transversely, with respect to a transport direction of the printing material which is guiding through the printing press, of at least one inking unit, which is arranged in the printing press, are indicated on a display surface of the display device of a control unit in a controlled manner. The inking zones are indicated by way of parallel boundary lines, which delimit them in each case. For the display of the boundary lines which delimit the inking zones, the control unit fixes one of the color thereof and the brightness thereof and the opaqueness thereof in a manner which is dependent on a minimum contrast which has previously been set in the control unit, in order to form an image region, adjoining the boundary lines, of the printed image which is displayed on the image surface of the display device and displays the boundary lines which delimit the (Continued)

inking zones in the contrast ratio which is fixed in respect of the printed image which is displayed on the display surface of the display device.

16 Claims, 2 Drawing Sheets

(56) References Cited

U.S. PATENT DOCUMENTS

| | | | | |
|---|---|---|---|---|
| 2006/0238834 | A1* | 10/2006 | Ozawa | H04N 1/6027 358/521 |
| 2008/0062419 | A1 | 3/2008 | Fejfar | |

FOREIGN PATENT DOCUMENTS

| | | | |
|---|---|---|---|
| EP | 1889721 | A2 | 2/2008 |
| EP | 2090434 | A1 | 8/2009 |
| EP | 2090434 | B1 | 12/2011 |

* cited by examiner

METHOD FOR CONTROLLING A DISPLAY DEVICE WHICH IS CONNECTED IN DATA TERMS TO A PRINTING PRESS, AND DISPLAY DEVICE OF A PRINTING PRESS

CROSS REFERENCE TO RELATED APPLICATIONS

This application is the U.S. National Phase, under 35 U.S.C. § 371, of PCT/EP2018/052385, filed Jan. 31, 2018; published as WO 2018/153628 A1 on Aug. 30, 2018, and claiming priority to DE 10 2017 202 937.4, filed Feb. 23, 2017, the disclosures of which are expressly incorporated herein in their entireties by reference.

FIELD OF THE INVENTION

The present invention relates to a method for controlling a display device that is connected in data terms to a printing press. A printed image, that has been printed by the printing press onto a printing substrate, together with a plurality of ink zones of at least one inking unit located in the printing press, is depicted. The ink zones are arranged side by side transversely to the direction of transport of the printing substrate being guided through the printing press. The depiction is controlled by a control unit on a display surface of a display device, and in which depiction, the ink zones are each indicated and are delimited by parallel boundary lines.

BACKGROUND OF THE INVENTION

From EP 2090434 B1, a method for operating a printing press, in particular a web-fed printing press, is known, in which, for printing onto a printing substrate, in particular onto at least one printing substrate web, ink zone adjustment elements configured as ink slides or ink blades, dependent upon the subject, in inking units of printing units of the printing press, and where applicable, dampening zone adjustment elements configured as dampening medium apertures or spray nozzles in dampening units of the printing units of the printing press, are set in such a way that a desired print image will be produced on the printing substrate to be imprinted, and in which the setting of ink zone adjustment elements and/or the setting of dampening zone adjustment elements is displayed in the form of a column or a bar on a monitor of a printing press control system, in particular on a control console monitor, with the setting of ink zone adjustment elements and/or the setting of dampening zone adjustment elements being displayed together with the print image on the monitor in such a way that columns or bars indicating the setting of ink zone adjustment elements of the printing unit and/or indicating the setting of dampening zone adjustment elements of the printing unit and/or indicating the ink density are superimposed onto the areas of the print image for which a volume of printing ink and/or a volume of dampening medium is set by means of the respective ink zone adjustment elements and/or dampening zone adjustment elements, with the target image that is printable with the respective settings of the ink zone adjustment elements and/or the dampening zone adjustment elements being displayed as the print image.

From DE 10 2011 075347 A1, a system for displaying a reference print image that simulates a print image of a printing press is known, in which a monitor is provided for displaying the reference print image, and in which the system comprises a process module for the program-assisted checking and/or calibration of the monitor with respect to its color reproduction, along with at least one control element assigned for controlling said process module, and/or a process module for performing program-assisted color measurement on a product copy, along with at least one control element assigned for controlling said process module, and/or a process module for selecting a section or a playback mode of the reference print image to be displayed by the monitor, along with at least one control element assigned for controlling said process module, wherein for visualizing and/or controlling the respective process module, a program mask that can be displayed in a window on a monitor is provided, the program mask having the at least one control element for controlling the program being executed by the process module, and the at least one control element being displayed as a soft key on the display surface of the monitor displaying the window.

Known from DE 10 2009 027142 A1 is a device for controlling a metering system of an inking unit and/or dampening unit of a web-fed rotary printing press that has a plurality of physical zones assigned to a printing unit, in which the ink volume or dampening medium volume of said zones can be adjusted individually by means of adjustment elements, said controlling device having at least one imaging display device, a software program that is run on a computer or in a memory means, and at least one user interface for receiving control commands issued or to be issued by the user, the software program being configured to visualize on the display device both a depiction of a print image to be viewed, relating to the current production run, and a group of sections that represent zones relating to the print image, and/or a group of activatable fields to be assigned to the adjustment elements of the zones relating to the print image.

SUMMARY OF THE INVENTION

The object of the present invention is to provide a method for controlling and/or for operating a display device that is connected in data terms to a printing press. Likewise, the object is to provide a display device for a printing press and a control console for a printing press that has such a display device.

The object is attained according to the invention in that, for the display of the boundary lines that delimit the ink zones, the control unit determines at least one of the hue and the brightness and the opacitiy of the boundary lines, each in a manner that is dependent upon a minimum contrast, set in advance in the control unit, to an image area, bordering the boundary lines, of the printed image that is displayed on the display surface of the display device. The boundary lines, that delimit the ink zones in the determined contrast ratio to the printed image are displayed on the display surface of the display device.

The advantages to be achieved with the invention consist, in particular, in that the ease of use of a display device, on the display surface of which, controlled by a control unit, a plurality of ink zones, arranged side by side transversely to the direction of transport of a printing substrate guided through the printing press, of at least one inking unit arranged in the printing press are or at least can be displayed, together with a depiction of the print image printed by means of the printing press onto the printing substrate, is guaranteed, even under unfavorable operating conditions, and the usability of the display device is improved. The invention thus improves the ergonomics of a generic display device.

BRIEF DESCRIPTION OF THE DRAWINGS

An exemplary embodiment of the present invention is illustrated in the set of drawings and will be described in greater detail below.

In the drawings.

DESCRIPTION OF THE PREFERRED EMBODIMENT

Figure 1:
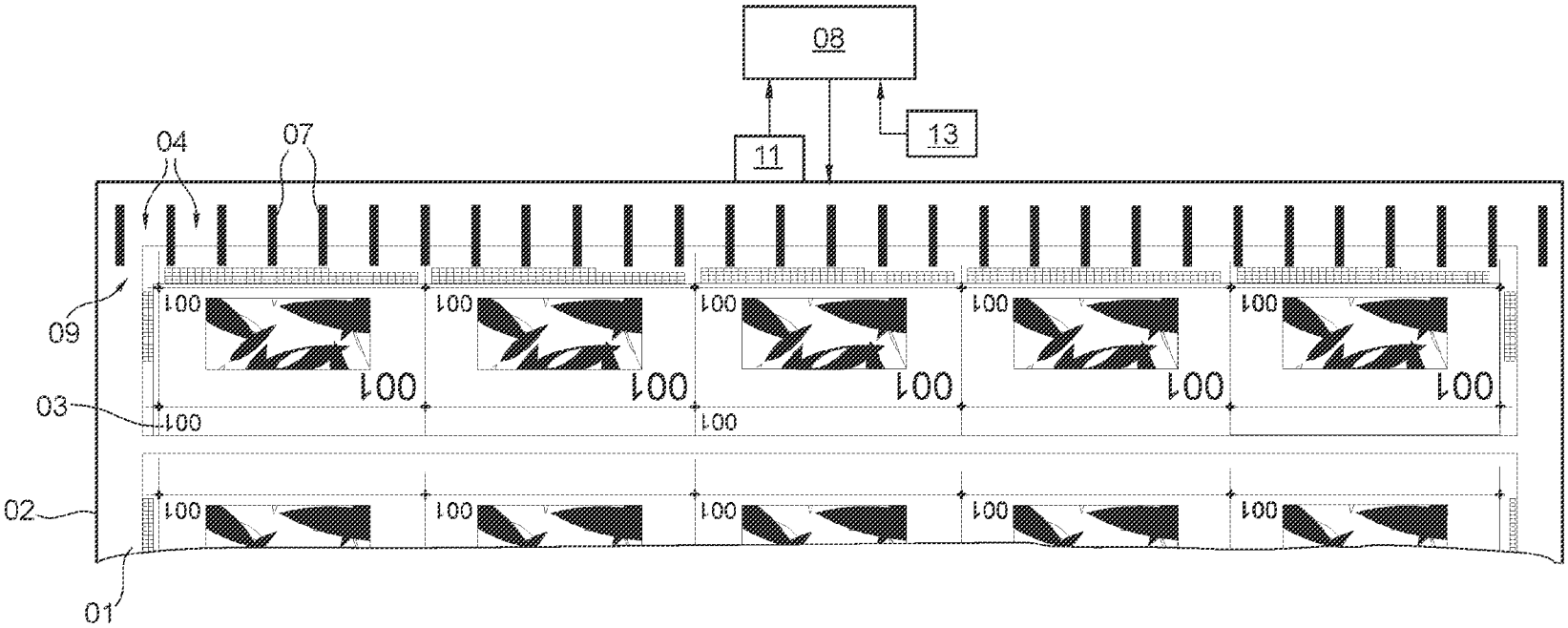
FIG. 1 shows a section of a printed image displayed on a display surface of a display device, together with ink zones of an inking unit superimposed thereon.

On a display surface of a display device that is connected in data terms, e.g. via a digital network, to a printing press, a preferably color-true, e.g., photographic depiction of a printed image that has been printed by means of the printing press onto a printing substrate, e.g. in an offset printing process or in a gravure printing process or in a letterpress printing process, is displayed, controlled by a preferably electronic, in particular programmable control unit, together with a plurality of ink zones, e.g., thirty or more, which are arranged side by side transversely to the direction of transport of the printing substrate being guided through the printing press, of at least one inking unit arranged in the printing press and preferably having one controllable ink metering device per ink zone. The ink zones are each indicated and delimited by parallel, straight boundary lines. It is proposed that for the display of the boundary lines that delimit the ink zones, the control unit determines the hue and/or the brightness and/or the opacity of said boundary lines in a manner that is dependent upon a minimum contrast, set in advance in the control unit, to an image area, bordering the boundary lines, of the printed image that is displayed on the display surface of the display device, and displays the boundary lines that delimit the ink zones in the determined contrast ratio to the printed image that is displayed on the display surface of the display device. The minimum contrast is set, e.g., to 10:1, preferably to 30:1 or higher. In determining the minimum contrast, e.g., the intensity of the ambient light surrounding the display surface of the display device and detected, e.g., by sensors is taken into account. The display surface of the display device has a screen diagonal of, e.g., 50 inches or larger and contains, e.g., more than 1 million pixels.

The term "contrast" refers to the difference between light and dark pixels or areas of an image, and in this case refers to the difference between a printed image displayed on the display surface of the display device and the boundary lines indicating the ink zones. A contrast range or contrast dynamic describes the difference in intensity between the lightest and the darkest pixel of the respective (entire) image being displayed on the display surface of the display device. The contrast is defined by the maximum luminance Lmax and the minimum luminance Lmin, each respective luminance referring here to the pixels in the display surface of the display device. The Weber contrast Kw, named for Ernst Heinrich Weber, is obtained by the following formula:

$$Kw=(L\max/L\min)-1, \text{ and } 0\leq Kw\leq\infty$$

When the minimum luminance reaches the black level Lmin=0, the contrast is infinite. If there is no difference between the two luminances Lmax and Lmin, the contrast is equal to zero.

If a depiction of a printed image printed onto a printing substrate by means of the printing press, and a plurality of ink zones of at least one inking unit arranged in the printing press, said ink zones being arranged side by side transversely to the direction of transport of the printing substrate being guided through the printing press, are displayed on the same display surface of a display device that is connected in data terms to the printing press, these displayed ink zones are recognizable and useful to an operator of the printing press only if the display of these ink zones differs significantly from the display of the depicted printed image, i.e., in particular with a minimum contrast, optionally taking the ambient light into account.

In practice, with a printing press configured, e.g., as a sheet-fed printing press or as a web-fed printing press, a multiplicity of print images that contain frequently changing motifs of any possible design in terms of coloring and/or brightness are printed onto a printing substrate, e.g., composed of paper, cardboard, paperboard, a plastic, or a metallic material, so that if the ink zones are displayed in a static, in particular rigidly fixed configuration together with, e.g., a photographic image of the respective printed image on the same display surface, the identifiability of the ink zones on said display surface is not always ensured due to a lack of contrast. It is therefore proposed according to the invention that, for the display of the boundary lines that delimit the ink zones, the control unit for controlling the display device should determine the hue and/or brightness of said boundary lines, adjusted variably, i.e., in terms of their contrast to the printed image currently being displayed, in a manner that is dependent upon a minimum contrast, set in advance in the control unit, e.g., automatically by means of a program or by an operator of the printing press using a (first) control element that is connected to the control unit, to an image area, bordering the boundary lines, of the printed image that is displayed on the display surface of the display device, and should then display the boundary lines that delimit the ink zones on the display surface of the display device, in the determined contrast ratio to the printed image being displayed on the display surface of the display device. The image area of the printed image displayed on the display surface of the display device, which is analyzed in advance, e.g., by the control unit, for the purpose of determining the contrast ratio, is, e.g., between 1% and 50%, preferably between 5% and 25%, of said printed image displayed on the display surface of the display device. A keyboard, a computer mouse, a trackball or some other suitable control element, for example, is used as the (first) control element connected to the control unit. The display device is configured, in particular, as an electronic screen, e.g., as a monitor, preferably as a touchscreen or as a Wallscreen, and/or is formed on or in conjunction with a control console of the printing press, so that the proposed method is preferably implemented at a control console of the printing press. The printed image, which is recorded by a camera that is located in the printing press and is configured, e.g., as a semiconductor camera, and which is displayed on the display surface of the display device is preferably displayed continuously in the form of a live image during a production run on the printing press.

In an advantageous embodiment of the identified solution, the boundary lines, each of which delimits at least one of the ink zones, are each displayed by the control unit on the display surface of the display device as a scale line of a scale that contains a plurality of sequential scale lines arranged transversely to the direction of transport of the printing substrate being guided through the printing press, wherein the vertical position of the scale on the display surface of the display device is adjusted automatically by the control unit in a manner that is dependent upon the printed image being displayed on the display surface of the display device, or the vertical position of the scale on the display surface of the display device is and/or can be adjusted infinitely within a certain range of a vertical extension of the display surface of the display device by means of a first control element, connected to the control unit.

It is also highly advantageous for the control unit to determine a respective horizontal position of the boundary lines that delimit the respective ink zones or of the respective scale lines of the scale, each in dependence upon a prior rectification of a horizontally extending, measurement-based distorted display of the printed image that is displayed on the display surface of the display device.

In a preferred embodiment, the horizontal position of a boundary line that delimits at least one ink zone or the horizontal position of a scale line of the scale, which horizontal line corresponds to a center line of the printing press extending in the direction of transport of the printing substrate being guided through the printing press, is adjusted automatically by the control unit on the display surface of the display device, or said position can be adjusted, e.g., by means of a (second) control element that is connected to the control unit.

To facilitate the selection of the ink zones of a particular inking unit in a printing press that comprises a plurality of inking units, it is provided, e.g., for a schematic depiction of a plurality of inking units arranged in the printing press to be displayed by the control unit on the display surface of the display device, and for a single one of these inking units to be selected and/or selectable by means of a (third) control element that is connected to the control unit.

It is further provided, e.g., that for each ink zone, a degree of opening of the respective metering device associated with said ink zone of the inking unit in question is displayed between the boundary lines or scale lines thereof, wherein, to improve the readability of the displayed degree of opening, said degree of opening is displayed, e.g., in the respective printing ink used by the inking unit in question for printing in said ink zone, and/or is displayed underlaid, e.g., by a circular, preferably white field.

FIG. 1 shows, by way of example, a section of a printed image 03 displayed on a display surface 01 of a display device 02, together with superimposed ink zones 04 of an inking unit 06. The example shown here relates to a sheet-fed printing press used for security printing, in which display device 02 is located on the control console of the press. On each of a multiplicity of sheets, copies, e.g., of banknotes are preferably printed in succession, e.g., a plurality of rows of banknotes arranged sequentially in the direction of transport of the sheets, each row containing a plurality of banknotes, e.g. five. Each of the individual banknotes is preferably multicolored in design. The banknotes printed onto the respective sheets in the printing process are imaged photographically, e.g., by row, in particular color-true, by means of a camera, e.g. configured as a line camera and arranged in the printing press, and are displayed as a printed image 03 in the form of a "live image", i.e. as a current playback of the ongoing production run, on display surface 01 of display device 02. To facilitate color control in the printing press, a plurality, e.g. all, of the ink zones 04 of an inking unit 06, in particular at least those ink zones that are required for the current production run, are displayed together with printed image 03 on display surface 01 of display device 02, with the individual ink zones 04 being indicated by straight, parallel boundary lines 07 that delimit said zones. According to the invention, for the display of the boundary lines 07 that delimit the ink zones 04, a preferably programmable control unit 08 for controlling display device 02 determines the hue and/or the brightness and/or the opacity of said boundary lines in a manner that is dependent upon a minimum contrast, set in advance in the control unit 08, to an image area 09, bordering the boundary lines 07, of the printed image 03 that is displayed on display surface 01 of display device 02, and displays the boundary lines 07 that delimit the ink zones 04 in the determined contrast ratio to the printed image 03 that is displayed on display surface 01 of display device 02. In determining the minimum contrast, e.g., the intensity of the ambient light surrounding display surface 01 of display device 02 is taken into account, said ambient light being detected, e.g., by a photosensitive semiconductor sensor 11, e.g. a photodiode, preferably located in or on display device 02.

Figure 2:
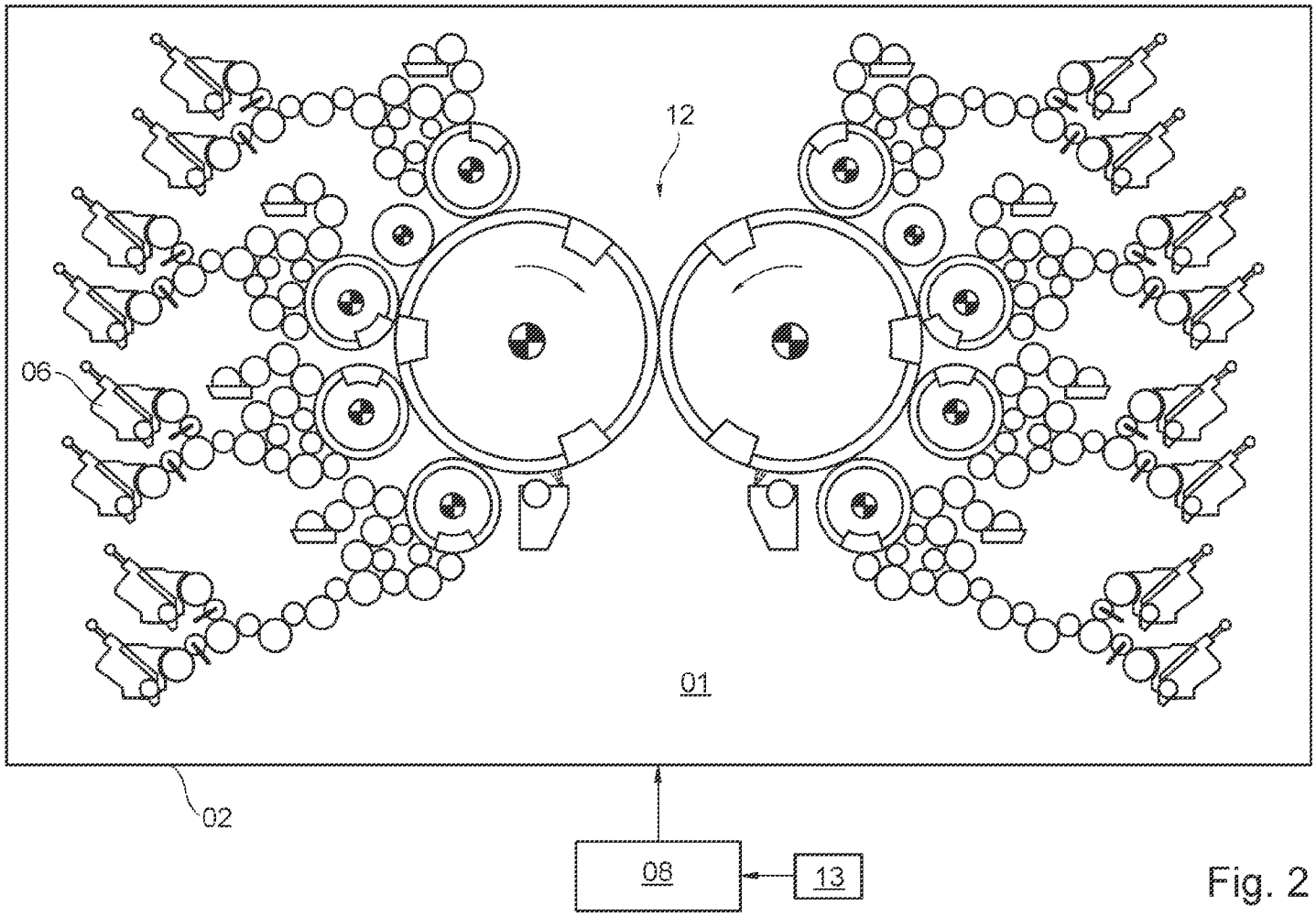
FIG. 2 shows a printing unit of a printing press, comprising a plurality of inking units, depicted schematically on the display surface of the display device, with the selection of a single inking unit.

FIG. 2 shows, by way of example, a printing unit 12 of a printing press, configured in particular as a sheet-fed rotary printing press, which printing unit has a plurality of inking units 06 and is depicted schematically on display surface 01 of display device 02, with the selection of a single inking unit 06. The selected inking unit 06 is highlighted graphically, e.g., by its coloring and/or its contrast to the surrounding image area. The selected inking unit 06 is displayed on display surface 01 of display device 02, e.g., lighter or darker than the remaining inking units 06 of said printing unit 12. The selection of the relevant inking unit 06 and the performance of certain above-described adjustments and/or determinations with respect to the selected inking unit 06 are carried out by means of one or more control elements 13 (FIG. 1), each connected to control unit 08 of display device 02.

While a preferred embodiment of a method for controlling a display device that is connected, in data terms, to a printing press, and a display device of such a printing press, has been set forth fully and completely herein above, it will be apparent to one of skill in the art that various changes could be made thereto, without departing from the true spirit and scope of the present invention, which is accordingly to be limited only by the appended claims.

The invention claimed is:

1. A method for controlling a display device that is connected in data terms to a printing press, in which method a depiction of a printed image (03) that has been printed by means of the printing press onto a printing substrate, together with a plurality of ink zones (04) of at least one inking unit (06) located in the printing press, said ink zones being arranged side by side transversely to the direction of transport of the printing substrate being guided through the printing press, are displayed, controlled by a control unit (08), on a display surface (01) of the display device (02), and in which the ink zones (04) are each indicated and delimited by parallel boundary lines (07), characterized in that for the display of the boundary lines (07) that delimit the ink zones (04), the control unit (08) determines the hue and/or the brightness and/or the opacity of said boundary lines, each in a manner that is dependent upon a minimum contrast, set in advance in the control unit (08), to an image area (09), bordering the boundary lines (07), of the printed image (03) that is displayed on the display surface (01) of the display device (02), and displays the boundary lines (07) that delimit the ink zones (04) in the determined contrast ratio to the printed image (03) that is displayed on the display surface (01) of the display device (02).

2. The method according to claim 1, characterized in that each of the boundary lines (07) that delimit at least one of the ink zones (04) is displayed by the control unit (08) on the display surface (01) of the display device (02) as a scale line of a scale comprising a plurality of sequential scale lines arranged transversely to the direction of transport of the printing substrate being guided through the printing press, wherein the vertical position of the scale on the display surface (01) of the display device (02) is and/or can be adjusted by the control unit (08), wherein the vertical position of the scale on the display surface (01) of the display device (02) is adjusted automatically by the control unit (08), in dependence upon the printed image (03) displayed on the display surface (01) of the display device (02), or wherein the vertical position of the scale on the display surface (01) of the display device (02) is and/or can be adjusted infinitely within a certain range of a vertical extension of the display surface (01) of the display device (02), by means of a first control element (13) that is connected to the control unit (08).

3. The method according to claim 1, characterized in that the control unit (08) determines the respective horizontal position of the boundary lines (07) that delimit the respective ink zones (04), or of the respective scale lines of the scale, each in dependence upon a prior rectification of a horizontally extending, measurement-based distorted display of the printed image (03) displayed on the display surface (01) of the display device (02), wherein the horizontal position of a boundary line (07) that delimits at least one ink zone (04), or the horizontal position of a scale line of the scale, which position corresponds to a center line of the printing press, extending in the direction of transport of the printing substrate being guided through the printing press, is adjusted automatically by the control unit (08) on the display surface (01) of the display device (02), or is or can be adjusted by means of a second control element (13) that is connected to the control unit (08).

4. The method according to claim 1, characterized in that a schematic depiction of a plurality of inking units (06) arranged in the printing press is displayed by the control unit (08) on the display surface (01) of the display device (02), wherein a single one of these inking units (06) is and/or can be selected by means of a third control element (13) that is connected to the control unit (08).

5. The method according to claim 1, characterized in that for each ink zone (04), a degree of opening of the respective metering device associated with said ink zone (04) of the inking unit (06) in question is displayed between the boundary lines (07) or scale lines of said ink zone.

6. The method according to claim 1, characterized in that the minimum contrast is determined in dependence upon the intensity of an ambient light surrounding the display surface (01) of the display device (02).

7. A display device for a printing press, having a control unit (08), wherein a depiction, displayed on a display surface (01) of the display device (02), of a printed image (03) that has been printed by means of the printing press onto a printing substrate, together with a plurality of ink zones (04) of at least one inking unit (06) located in the printing press, said ink zones being arranged side by side transversely to the direction of transport of the printing substrate being guided through the printing press, is controlled by a control unit (08), wherein the ink zones (04) are each indicated and delimited by parallel boundary lines (07), characterized in that for the display of the boundary lines (07) that delimit the ink zones (04), the control unit (08) determines the hue and/or the brightness and/or the opacity of said boundary lines, each in a manner that is dependent upon a minimum contrast, set in advance in the control unit (08), to an image area (09), bordering the boundary lines (07), of the printed image (03) that is displayed on the display surface (01) of the display device (02), and displays the boundary lines (07) that delimit the ink zones (04) in the determined contrast ratio to the printed image (03) that is displayed on the display surface (01) of the display device (02).

8. The display device according to claim 7, characterized in that each of the boundary lines (07) that delimit at least one of the ink zones (04) is displayed by the control unit (08) on the display surface (01) of the display device (02) as a scale line of a scale comprising a plurality of sequential scale lines arranged transversely to the direction of transport of the printing substrate being guided through the printing press, wherein the vertical position of the scale on the display surface (01) of the display device (02) is and/or can be adjusted by the control unit (08), wherein the vertical position of the scale on the display surface (01) of the display device (02) is adjusted automatically by the control unit (08), in dependence upon the printed image (03) displayed on the display surface (01) of the display device (02), or wherein the vertical position of the scale on the display surface (01) of the display device (02) is or can be adjusted infinitely within a certain range of a vertical extension of the display surface (01) of the display device (02), by means of a first control element (13) that is connected to the control unit (08).

9. The display device according to claim 7, characterized in that the control unit (08) determines the respective horizontal position of the boundary lines (07) that delimit the respective ink zones (04), or of the respective scale lines of the scale, each in dependence upon a prior rectification of a horizontally extending, measurement-based distorted display of the printed image (03) displayed on the display surface (01) of the display device (02), wherein the horizontal position of a boundary line (07) that delimits at least one ink zone (04) or the horizontal position of a scale line of the scale, which position corresponds to a center line of the printing press, extending in the direction of transport of the printing substrate being guided through the printing press, is adjusted automatically by the control unit (08) on the display surface (01) of the display device (02), or is or can be adjusted by means of a second control element (13) that is connected to the control unit (08).

10. The display device according to claim 7, characterized in that a schematic depiction of a plurality of inking units (06) arranged in the printing press is displayed by the control unit (08) on the display surface (01) of the display device (02), wherein a single one of these inking units (06) is or can be selected by means of a third control element (13) that is connected to the control unit (08).

11. The display device according to claim 7, characterized in that for each ink zone (04), a degree of opening of the respective metering device associated with said ink zone (04) of the inking unit (06) in question is displayed between the boundary lines (07) or scale lines of said ink zone.

12. The display device according to claim 7, characterized in that a photosensitive semiconductor sensor (11) is arranged in or on the display device (02), wherein said semiconductor sensor (11) detects the intensity of an ambient light surrounding the display surface (01) of the display device (02), wherein the control unit (08) determines the minimum contrast in dependence upon the intensity of the ambient light surrounding the display surface (01) of the display device (02).

13. The display device according to claim 7, characterized in that a minimum contrast adjusted by the control unit (08) is set to at least 10:1 or 30:1 or higher.

14. A control console of a printing press having a display device (02) according to claim 7, wherein the display device (02) is configured as an electronic screen or as a touchscreen or as a Wallscreen and/or wherein the display device (02) has a screen diagonal of 50 inches or larger and has more than 1 million pixels, and/or wherein the display device (02) is connected in data terms to the printing press via a digital network.

15. The display device according to claim 7, characterized in that the printing press is configured as one of a sheet-fed printing press and as a web-fed printing press, and as a printing press that prints in one of an offset printing process and in a gravure printing process and in a letterpress printing process.

16. The control console according to claim 14, characterized in that the printing press is configured as one of a sheet-fed printing press and as a web-fed printing press, and as a printing press that prints in one of an offset printing process and in a gravure printing process and in a letterpress printing process.

* * * * *